US009909806B2

(12) United States Patent
Schwerer et al.

(10) Patent No.: US 9,909,806 B2
(45) Date of Patent: Mar. 6, 2018

(54) DRYER FOR LACQUERING FACILITY

(75) Inventors: Peter Schwerer, Herrenberg (DE); Peter Obstfelder, Starzach (DE)

(73) Assignee: EISENMANN SE, Boeblingen (DE)

( * ) Notice: Subject to any disclaimer, the term of this patent is extended or adjusted under 35 U.S.C. 154(b) by 2191 days.

(21) Appl. No.: 12/920,651

(22) PCT Filed: Mar. 3, 2009

(86) PCT No.: PCT/EP2009/001497

§ 371 (c)(1),
(2), (4) Date: Oct. 5, 2010

(87) PCT Pub. No.: WO2009/109358

PCT Pub. Date: Sep. 11, 2009

(65) Prior Publication Data

US 2011/0023314 A1 Feb. 3, 2011

(30) Foreign Application Priority Data

Mar. 5, 2008 (DE) ..... 10 2008 012 792

(51) Int. Cl.
*F26B 23/02* (2006.01)

(52) U.S. Cl.
CPC ..... *F26B 23/022* (2013.01); *F26B 2210/12* (2013.01)

(58) Field of Classification Search
CPC .... F26B 23/022; F26B 23/024; F26B 23/026; F26B 23/028; F26B 23/001; F26B 23/002; F26B 23/007; F26B 21/002; F26B 2210/12
USPC ..... 34/270, 271, 272, 467, 478, 666, 479, 34/514, 477, 86; 110/203, 305; 432/72
See application file for complete search history.

(56) References Cited

U.S. PATENT DOCUMENTS

| | | | | |
|---|---|---|---|---|
| 3,627,289 | A * | 12/1971 | Erman | 134/19 |
| 4,164,819 | A * | 8/1979 | Devillard | 34/467 |
| 4,662,840 | A | 5/1987 | Ellison | |
| 4,728,284 | A * | 3/1988 | Coppin | 431/182 |
| 4,771,552 | A | 9/1988 | Morioka | |
| 5,868,562 | A | 2/1999 | Watanabe et al. | |
| 5,950,322 | A | 9/1999 | Knabe | |

(Continued)

FOREIGN PATENT DOCUMENTS

| | | |
|---|---|---|
| DE | 1 907 714 | * 10/1971 |
| DE | 1 907 714 B | 10/1971 |

(Continued)

*Primary Examiner* — Jianying Atkisson
*Assistant Examiner* — Tavia Sullens

(57) ABSTRACT

The invention relates to a dryer for a lacquering facility: a) having a dryer housing, in which heated air is circulated, b) having an exhaust air line for a exhausting exhaust air from the dryer housing; c) having a combustion unit, which is connected to the exhaust air line, and which is used for thermal post-treatment of the exhaust air from the dryer housing and for providing hot air to a heat exchanger; d) wherein said heat exchanger is set up to supply said dryer housing with heated fresh air; and wherein e) at least one heating unit for heating the air circulated in said dryer housing is associated with said dryer housing. It is provided according to the invention that a combustion air supply of the heating unit is connected so it communicates with the dryer housing.

14 Claims, 4 Drawing Sheets

(56) References Cited

U.S. PATENT DOCUMENTS

| | | | | |
|---|---|---|---|---|
| 6,418,636 | B1 | 7/2002 | Sonner | |
| 6,935,052 | B2 * | 8/2005 | Sonner et al. | 34/666 |
| 2007/0144036 | A1 | 6/2007 | Apostolos et al. | |

FOREIGN PATENT DOCUMENTS

| | | | |
|---|---|---|---|
| DE | 196 54 043 | A1 | 7/1997 |
| DE | 197 35 322 | A1 * | 2/1999 |
| DE | 1 076 218 | A1 | 2/2001 |
| DE | 199 37 901 | C2 | 2/2001 |
| EP | 1 801 526 | A2 | 6/2007 |

* cited by examiner

DRYER FOR LACQUERING FACILITY

RELATED APPLICATIONS

This application claims the filing benefit of Germany Patent Application No. PCT PCT/EP2009/001497, filed Mar. 3, 2009, which claims the filing benefit of Germany Patent Application No. 10 2008 012 792.2 filed Mar. 5, 2008, the contents of which are incorporated herein by reference.

TECHNICAL FIELD

The invention relates to a dryer for a painting facility a) having a dryer housing, in which heated air is circulated;
b) having an exhaust air line for removing exhaust air from the dryer housing;
c) having a combustion device, which is connected to the exhaust air line and which serves for thermal post-treatment of the exhaust air from the dryer housing and for providing heating air to a heat exchanger;
d) the heat exchanger being set up to supply the dryer housing with heated fresh air and
e) at least one heating device for heating the air circulated in the dryer housing being associated with the dryer housing.

BACKGROUND OF THE INVENTION

A dryer known from the prior art is used for drying paint coats on motor vehicle bodies and for this purpose provides heated air in a dryer housing, which is also called a dryer tunnel. With the aid of the heated air, solvents present in the paint coat(s) can be evaporated, in order to achieve curing of the paint coat.

Additionally or alternatively, the heated air can bring about crosslinking of polymer chains in the paint coat, so as to give the latter a desired strength. Through the evaporation of the solvent, which may be water inter alia, the heated air in the dryer housing is cooled and becomes enriched with the evaporated solvent. In order to guarantee uniform heat treatment of the motor vehicle bodies and uniform drying of the paint coats, circulation of the air in the dryer housing must take place. Furthermore, heat must be supplied to the dryer housing in order to maintain the temperature of the air at a predeterminable minimum level, since the temperature drops due to evaporation processes and heating of the workpieces. In addition, the air charged with solvent must be exchanged and purified in order to keep the drying rate of the dryer constant.

In order to ensure that the air withdrawn from the dryer housing for regeneration purposes can be discharged into the environment as unpolluted as possible, in the case of the known dryer the exhaust air is drawn off from the dryer housing by means of a fan and supplied to a combustion device. In the combustion device, which in particular can take the form of a thermal post-combustion device (TPC) or a regenerative post-combustion device (RPC), an ignitable mixture with the exhaust air is formed by supplying a fuel, in particular gas, and the mixture is burnt. In the process, substantial neutralisation of the pollutants present in the exhaust air takes place. The exhaust gas, heated by the combustion process, from the combustion device is passed via a heat exchanger, which enables at least partial release of the thermal energy contained in the exhaust gas to a fresh air flow, which for its part is supplied as heated air to the dryer housing after flowing through the heat exchanger.

Additionally, a plurality of heating units can be provided along the dryer housing, each of these being intended for sectional heating of corresponding dryer housing sections. The heating units produce an ignitable mixture of ambient air and a fuel, in particular gas, and burn this mixture. The thermal energy resulting from this is released to the air circulated in the dryer housing.

In view of the large quantities of heat which have to be provided for drying paint coats on motor vehicle bodies, considerably energy costs arise during operation of such a dryer. Particularly during part-load operation of the dryer, when the combustion device optimised for a maximum exhaust air flow rate has to be operated away from an advantageous operating point, the energy costs produce a high proportion of the overall operating costs incurred for the operation of the dryer and thus high unit costs per drying part.

The present invention is directed to resolving these and other matters.

SUMMARY OF THE INVENTION

An object of the invention is to improve a dryer of the type mentioned at the outset such that it can be operated both in full-load operation and in part-load operation with a favourable energy and cost balance.

This object may be achieved by a dryer having a dryer housing, in which heated air is circulated; an exhaust air line for removing exhaust air from the dryer housing; a combustion device, which is connected to the exhaust air line and which serves for thermal post-treatment of the exhaust air from the dryer housing and for providing heating air to a heat exchanger; the heat exchanger being set up to supply the dryer housing with heated fresh air; and at least one heating device for heating the air circulated in the dryer housing being associated with the dryer housing, characterised in that a combustion air supply of the heating device is connected in a communicating manner to the dryer housing.

This object is achieved by a dryer having the features of Claim 1.

The dryer according to the invention has a combustion air supply for the at least one heating device which is connected in a communicating manner to the dryer housing. Thus, a part of the air circulated in the dryer housing, together with a fuel, in particular gas, serves for forming an ignitable mixture, which is burnt in the heating device. In the course of the burning of at least a part of the exhaust air from the dryer housing in the heating device, at least partial neutralisation of pollutants in the exhaust air takes place, in a similar manner to that in the combustion device for the exhaust air which is further provided on the dryer. Thus, the communicating connection of the combustion air connection of the heating device to the dryer housing enables at least partial treatment of that part of the exhaust air which is withdrawn from the dryer housing for the heating device. As a result, it is possible to dimension the combustion device, which is actually provided for the treatment of the exhaust air, such that it can work optimally in part-load operation of the dryer.

In full-load operation of the dryer, the combustion device is supported by the action of the heating devices both with regard to the heating of the air in the dyer housing and with regard to the treatment of the exhaust air. This enables smaller dimensioning of the combustion device compared with known dryers, which device can be optimised, for example, for 75 percent utilisation of the dryer. The dryer can thus be operated in part-load operation more energy-efficiently and thus also at lower cost.

It is advantageous when the heating device has an exhaust gas line for removing exhaust gases, which leads into the exhaust air line. This guarantees that the exhaust air which is removed from the dryer housing as combustion air by the heating device and has possibly only undergone partial pollutant reduction by the combustion process taking place in the heating device is always still supplied to the combustion device. It is thus ensured that the desired pollutant reduction takes place also during full-load operation of the dryer. The pretreatment of the exhaust air taking place in the heating device results in heating of the exhaust air to a temperature which lies considerably above the temperature of the circulated air prevailing in the dryer housing. The combustion device thus merely has to heat slightly the exhaust gas volume flows supplied from the heating devices at full load. The additional quantity of thermal energy to be provided by the combustion device for this purpose has only a minor influence on the dimensioning of the combustion device optimised for 75 percent part-load operation.

In an advantageous development of the invention, it is provided that an adjustable throttle device is arranged in the exhaust gas line of the heating device and/or in the exhaust air line upstream of the point where the exhaust gas line leads into it. With the aid of such throttle devices, the ratio between an exhaust air volume flow drawn off directly from the dryer housing and supplied to the combustion device and an exhaust air volume flow which first passes through one of the heating devices and is pretreated there by heating can be adjusted. It is preferably provided that the throttle devices in the exhaust gas lines of the heating devices are completely closed in part-load operation, in order to avoid undesired heat losses in the heating devices due to the throughflow with exhaust air. In contrast, during full-load operation, all the throttle devices are fully open, in order to guarantee an as far as possible undisturbed flow of exhaust air both through the heating devices and directly in the exhaust air line in the direction of the combustion device.

It is advantageous when an air supply line of the heating device has at least one branch for providing to the heating device a first exhaust air partial flow serving as a combustion air flow and a second exhaust air partial flow serving as a useful air flow. Thus, both the combustion air and the useful air are removed from the dryer housing through a common air supply line. As a result, a simple construction is achieved and costly insulation measures for separate lines can be avoided. In particular, it can be provided that the combustion air flow is withdrawn from a shaft for the useful air. As a result, a particularly simple configuration of the connection between heating device and dryer housing can be achieved.

In a further refinement of the invention, it is provided that the heating device has a useful air inlet and a useful air outlet, which are connected in a communicating manner to the dryer housing. A heat release of the heating device takes place by useful air flowing past a heat exchanger. For this purpose, the useful air is drawn off from the dryer housing directly via a useful air inlet and supplied to the dryer tunnel again via a useful air outlet which opens into the dryer housing. As a result, an efficient heat transfer between the burning mixture of combustion air and fuel and the useful air is guaranteed. In addition, owing to the direct connection between dryer housing and heating device, an arrangement of a plurality of heating devices on the dryer housing can be accomplished without costly piping.

In an advantageous development of the invention, it is provided that a plurality of heating devices are arranged along the dryer housing. As a result, a zonal provision of heat individually according to the requirements of the drying process can be achieved.

It is advantageous when a hot air outlet of the heat exchanger is connected to an end region, in particular to a lock region, of the dryer housing. The greatest demand for heat exists in the end regions of the dryer housing, since on the one hand the painted articles, in particular motor vehicle bodies, have to be transferred into and out of the dryer housing through lock devices and considerable heat losses occur in the lock regions. At the inlet lock, the still comparatively cold articles provided with a coating to be dried absorb a lot of heat. Moreover, the functioning of the locks is thereby assisted, since the heated air provided by the hot air outlet of the heat exchanger creates an overpressure in the lock regions which reduces penetration of dirt particles into the dryer housing.

In an advantageous development of the invention, it is provided that the heating device is arranged above the dryer housing. As a result, the installation area requirement for the dryer housing can be kept low.

It is advantageous when a transverse extent of the heating device corresponds to a part of the transverse extent of the dryer housing. As a result, a catwalk can be mounted at least on one side on the roof of the dryer housing where the heating device is advantageously arranged. The catwalk allows the heating device to be reached easily and thus enables quick access to the heating device in the event of maintenance.

In a refinement of the invention, it is provided that the air inlet and the air outlet are connected in a communicating manner in each case to air shafts arranged laterally on the dryer housing and provided with air-permeable wall sections. The air inlet and the air outlet of the heating device are in each case connected in a communicating manner to air shafts which are structurally separated from one another. The air shafts in each case have at least one air-permeable wall section which is connected in a communicating manner to the inner cross-section of the dryer housing in which the articles to be dried are guided. With the aid of the air shafts and the air-permeable wall sections, a substantially horizontal air volume flow, preferably oriented perpendicularly to the transporting direction of the articles to be dried, can be produced in the dryer housing. As a result, an advantageous heat transfer between the air circulated in the dryer housing and the articles to be dried is achieved.

In an advantageous development of the invention, the combustion device is designed for part-load operation of the dryer. Part-load operation exists when either the maximum conveying speed for the articles to be dried and/or the maximum heat requirement for the drying of the articles does not have to be produced. This is the case, for example, when the number of articles to be dried per unit of time is less than a maximum piece number and/or when the heat requirement per article is lower than a maximum provided heat requirement per article. Through this design, the combustion device works with maximum efficiency even at only partial utilisation of the dryer and thus enables low energy costs per article to be dried also at part load.

It is advantageous when the combustion device is designed to produce 75 percent of the heating power required for maximum operation, based on maximum utilisation of the dryer. Consequently, the combustion device can be operated at its operating point with maximum energy efficiency at only partial utilisation of the dryer. At full utilisation, the combustion device is supported by the heating devices. Similarly, the thermal post-treatment of the exhaust air to be performed by the combustion device is also optimised for 75 percent utilisation of the dryer. At greater utilisation of the dryer, the exhaust air treatment is supported by the heating devices.

It is to be understood that the aspects and objects of the present invention described above may be combinable and that other advantages and aspects of the present invention will become apparent upon reading the following description of the drawings and detailed description of the invention.

DETAILED DESCRIPTION OF THE PRESENT INVENTION

Figure 1:
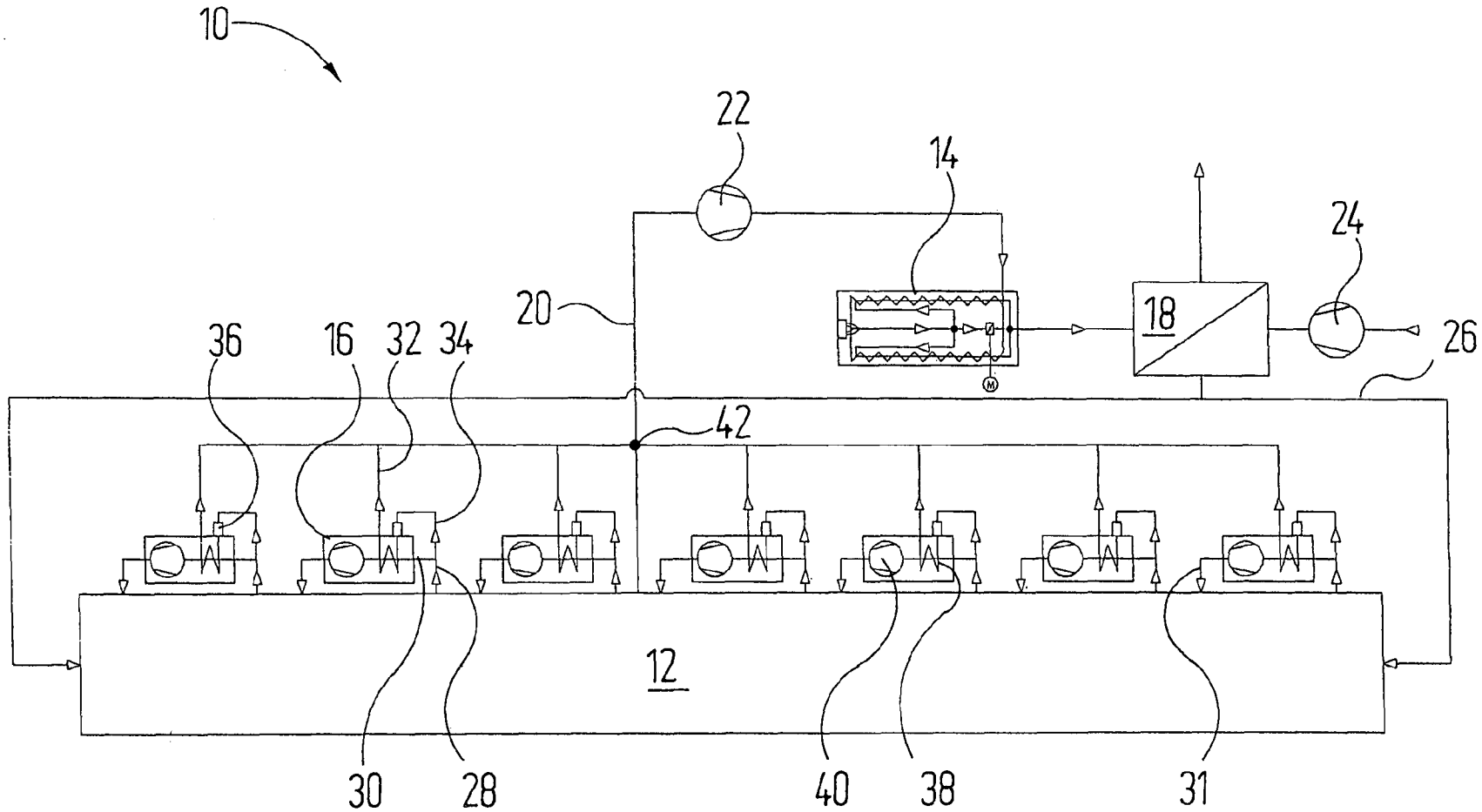
FIG. 1 shows a schematic illustration of a dryer having a thermal post-combustion device and a plurality of heating units.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

The dryer 10 illustrated schematically in FIG. 1 comprises a dryer housing 12, through which motor vehicle bodies (not illustrated) can be guided in continuous operation. Heated air is supplied to the dryer housing 12, in order to initiate and/or accelerate a drying process of a paint coating applied to the motor vehicle body and/or bring about crosslinking of the paint coating. In a cross-sectional plane oriented perpendicularly to the plane of the drawing in FIG. 1, the dryer housing 12 has a substantially rectangular cross-section, as can also be seen from the illustrations of FIGS. 2 to 4.

Above the dryer housing 12 are arranged a thermal post-combustion device 14, as well as a plurality of identically constructed heating units 16 and a heat exchanger 18.

The thermal post-combustion device 14 is a gas burner which mixes the exhaust air from the dryer housing 12, which air is provided via an exhaust air line 20 and an exhaust air fan 22 intended for conveying the exhaust air, with natural gas and burns the mixture. This results in a temperature increase, whereby the pollutants present in the exhaust air can be at least partially neutralised. The exhaust air treated by heating in the thermal post-combustion device 14 is delivered to the heat exchanger 18, intended for heating fresh air which is provided to the dryer housing 12. The fresh air is supplied via a fresh air fan 24 to the heat exchanger 18 and from there via fresh air lines 26 to the dryer housing 12, preferably at the entrance and exit of the dryer housing 12.

The design of the thermal post-combustion device 14 is chosen such that a quantity of heat can be provided to the dryer housing 12 which is required for operation of the dryer 10 with approximately 75 percent utilisation. In addition, the thermal post-combustion device 14 is dimensioned such that the temperature attainable therein still reaches the temperature value required for the exhaust air withdrawn from the dryer housing 12, at maximum heating power of the thermal post-combustion device 14 and 75 percent utilisation of the dryer 10.

In order to be able to ensure the supply of thermal energy sufficient for the drying and also the temperature necessary for the exhaust air purification in the thermal post-combustion device 14 during full-load operation, the heating units 16 are provided, and they are arranged as compact gas burner units on the roof of the dryer housing 12. Each of the heating units 16 has supply air and useful air lines 28, 31 connected in a communicating manner to the dryer housing 12. A combustion air line 34 branches off from the supply air line 28 and leads into a schematically illustrated burner 36 of the heating unit 16. There, the exhaust air from the dryer housing 12 flowing in through the combustion air line 34 is supplied, via a fuel line (not illustrated), with natural gas, which is burnt together with the exhaust air in the burner 36. The exhaust gases released in the process are passed through a heat exchanger 38 inside the heating unit 16 and discharged via an exhaust gas line 32, which is connected as a collecting line to all the heating units 16 and leads into the exhaust air line 20 at a junction 42.

With the aid of the heat exchanger 38, a portion of useful air withdrawn from the dryer housing 12 via the supply air line 28 and a useful air line 30 branching off therefrom is heated, it being drawn in by means of a conveying fan 40 and after passing through the heat exchanger 38 and the conveying fan 40 being led via the useful air line 31 back into the dryer housing 12.

During part-load operation of the dryer 10, the heat provided by the thermal post-combustion device 14 is sufficient for thermal treatment of the exhaust air and heating of the fresh air in the heat exchanger 18 to the required operating temperature of the dryer 10. Since the thermal post-combustion device 14 optimised for part-load operation cannot guarantee the heat supply alone during full-load operation of the dryer 10, the heating units 16 are activated in this case and supply additional heat to the dryer housing 12. Through the removal of exhaust air from the dryer housing 12 via the supply air lines 28 and the division, provided there, into a useful air flow and a combustion air flow, a part of the air circulated in the dryer housing 12 is intensely heated in the burners 36 of the heating units 16 during the combustion. Thus, already in the heating units 16, partial neutralisation of the pollutants accumulated in the exhaust air is guaranteed. The hot exhaust gas from the heating units 16 is supplied to the exhaust air line 20 via the exhaust gas line 32. As a result, the mixture composed of exhaust gases of the heating units 16 and the exhaust air withdrawn directly from the dryer housing 12 via the exhaust air line 20 has a markedly increased temperature level. Thus, during full-load operation and with a substantially constant heat supply in the thermal post-combustion device 14, the required temperature necessary for neutralising the exhaust gases can be maintained, despite the markedly higher exhaust air volume flow.

In part-load operation, the dryer 10 is therefore operated solely with the heat supply of the thermal post-combustion device 14 and with capacity of the latter for exhaust gas post-treatment of the exhaust air from the dryer housing 12. In the case of full-load operation, the heating units 16 intervene in a supporting manner both with regard to the heat supply to the dryer housing 12 and with regard to the preheating and partial thermal treatment of the exhaust air from the dryer housing 12.

Figure 2:
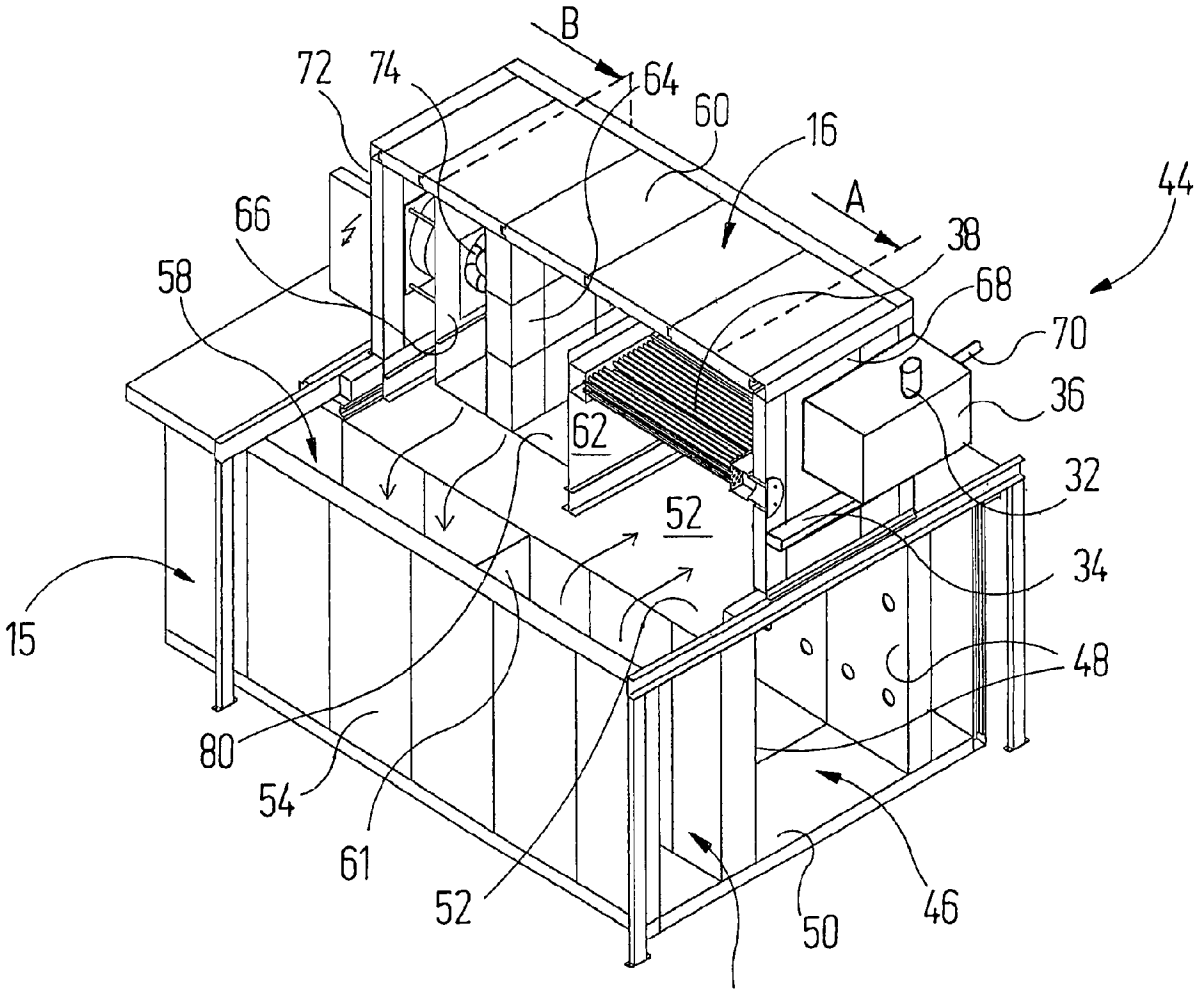
FIG. 2 shows a perspective illustration of a module of the dryer according to FIG. 1, provided with a heating unit.
Figure 3:
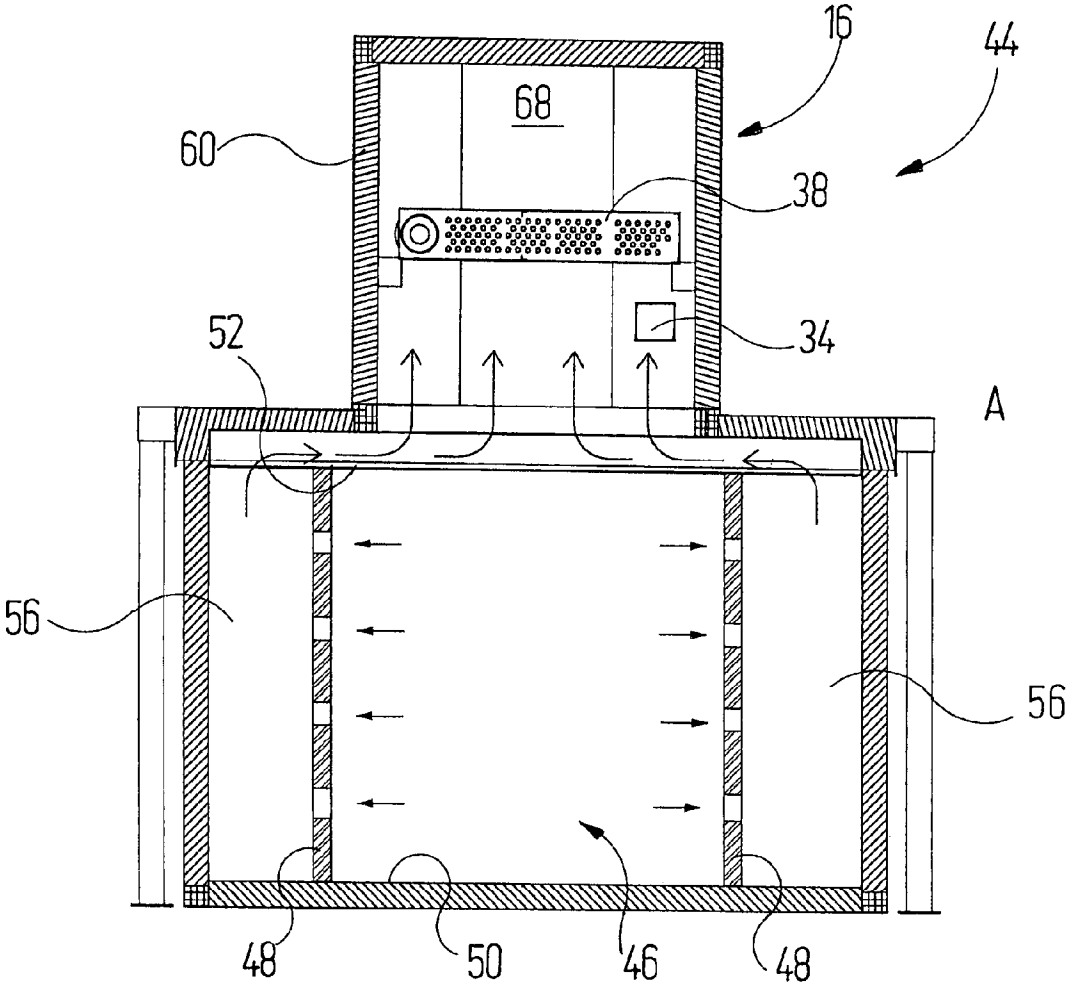
FIG. 3 shows a first sectional illustration of the module according to section plane A in FIG. 2.
Figure 4:
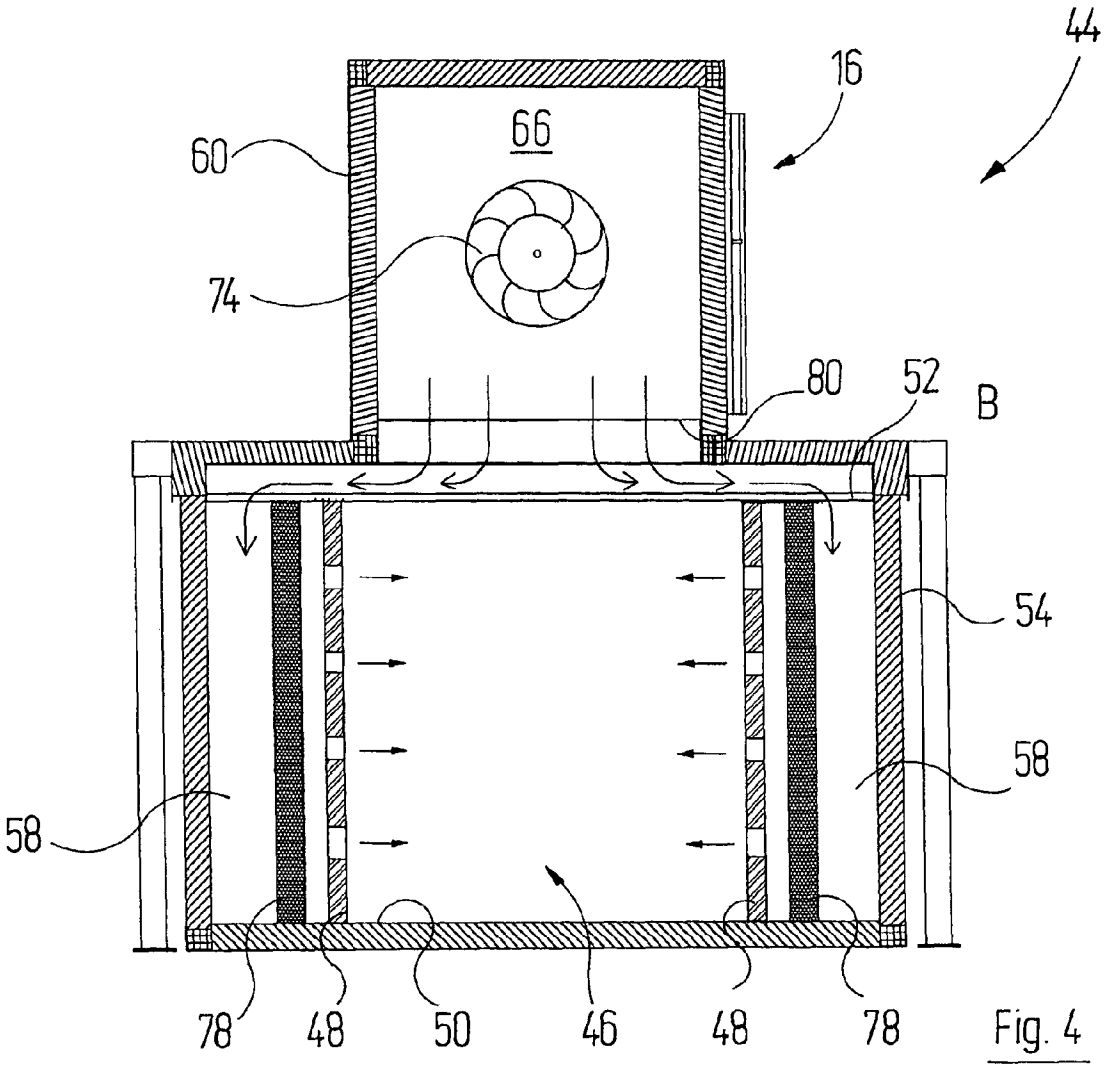
FIG. 4 shows a second sectional illustration of the module according to section plane B in FIG. 2.

The dryer 10 schematically illustrated in FIG. 1 is constructed from a plurality of dryer modules 44 connected in series, as illustrated in more detail in FIGS. 2 to 4. The dryer module 44 comprises a dryer housing section 15 and a heating unit 16 arranged on the roof of the dryer housing section 15. The dryer housing section 15 has a two-shell design. A dryer tunnel 46 is in this case bounded by vertically oriented perforated walls 48, floor plates 50 and ceiling plates 52. Formed between the perforated walls 48 and the outer walls 54, arranged spaced therefrom, are exhaust air shafts 56 and supply air shafts 58 which are in each case separated by bulkheads 61. These shafts serve for drawing off exhaust air from the dryer tunnel 46 and for supplying useful air to the dryer tunnel 46, respectively.

The heating unit 16 is accommodated in an insulated housing 60 which, for its part, lies on the ceiling plates 52 of the dryer housing section 15. The heating unit 16 has a transverse extent perpendicular to a longitudinal axis of the dryer module 44 which is less than the transverse extent of the dryer housing section 15, so that a region accessible for maintenance work remains on both sides of the heating unit 16. Provided in the housing 60 are a first partition wall 62, a filter wall 64 and a further partition wall 66, the function of which will be explained in more detail below.

Attached to an end-side outer wall 68 of the housing 60 is the burner 36, which is connected in a communicating manner to the exhaust air shaft 56 via the combustion air line 34 configured as a rectangular shaft and which additionally has a fuel line 70. In the burner 36, the exhaust air drawn off from the exhaust air shaft 56 through the combustion air line 34 is mixed with natural gas, supplied through the fuel line 70, and burnt. The exhaust gas released in the process is passed through the heat exchanger 38 and subsequently flows via the exhaust gas line 32 to the exhaust air line 20 (not illustrated in FIGS. 2 to 4).

Attached to a second end-side outer wall 72 of the dryer housing section 15 is an electric motor (not visible), the motor shaft of which is connected in a rotationally fixed manner to a fan wheel 74 of a radial fan. The fan wheel 74 is arranged between the outer wall 72 and the partition wall 66, terminating at its front side with the partition wall 66. An intake opening, arranged in the partition wall 66, for the radial fan allows exhaust air to be drawn in through the filter wall 64. The exhaust air thus flows out of the dryer tunnel 46 through the perforated walls 48 into the exhaust air shaft 56. From there, a predominant part of the exhaust air is led past the heat exchanger 38 as useful air and heated in the process. Subsequently, the useful air flows through the filter wall 64, made of a porous filter cloth, behind which the fan wheel 74 creates a negative pressure. Owing to the pressure conditions caused by the rotating fan wheel 74, the heated and filtered air subsequently flows off into the supply air shafts 58. From there, the heated useful air can enter the dryer tunnel 46 again through filter mats 78 provided at the rear side of the perforated walls 48 and arranged spaced from the perforated walls 48.

In the cross-sectional illustration of FIG. 3 it can be seen how the exhaust air drawn off from the dryer tunnel 46 through perforated walls 48 flows into the exhaust air shafts 56 and from there across ceiling plate 52 in the direction of the heat exchanger 38. A part of the exhaust air is drawn off into the combustion air line 34 by the burner 36 and used for the combustion of the burnable gas. The remaining exhaust air volume flow passes through the filter wall 64 (not illustrated) owing to the sucking action of the fan wheel 74, in order subsequently to flow into the supply air shafts 58 after flowing around the ceiling plate 52, in the manner illustrated in FIG. 4. From the supply air shafts 58, the heated useful air flows through the filter mats 78 of the perforated walls 48 into the dryer tunnel 46.

In order to guarantee a compact configuration of the heating unit 16 and achieve an advantageous flow of the filtered and heated useful air, a floor 80 (visible in FIGS. 2 and 4) arranged spaced from the ceiling plates 52 of the dryer housing 12 is provided between the partition wall 62 and the partition wall 66. This floor 80 enables a distribution of the air flow, drawn in by the fan wheel 74, into the supply air shafts 58 arranged on both sides of the dryer tunnel 46.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A dryer for a painting facility a) having a dryer housing, in which heated air is circulated;

b) having an exhaust air line for removing exhaust air from the dryer housing;

c) having a thermal combustion device, which is connected to the exhaust air line and which serves for thermal post-treatment of the exhaust air from the dryer housing and for providing heating air to a heat exchanger;

d) the heat exchanger being set up to supply the dryer housing with heated fresh air; and e) at least one heater for heating the air circulated in the dryer housing being associated with the dryer housing, wherein f) a combustion air supply of the at least one heater is connected in a communicating manner to the dryer housing and is configured to intervene in a supporting manner with regard to a preheating and partial thermal treatment of the exhaust air from the dryer housing such that the thermal combustion device is capable of being deliberately under-dimensioned in capacity to a part-load of the capacity of the dryer, only.

2. The dryer of claim 1, wherein the at least one heater has an exhaust gas line for removing exhaust gases, which leads into the exhaust air line.

3. The dryer of claim 1, wherein at least one adjustable throttle device is arranged in the exhaust gas line of the at least one heater and/or in the exhaust air line upstream of the point where the exhaust gas line leads into the exhaust air line.

4. The dryer of claim 1, wherein an air supply line of the at least one heater has at least one branch for providing to the at least one heater a first exhaust air partial flow serving as a combustion air flow and a second exhaust air partial flow serving as a useful air flow.

5. The dryer of claim 1, wherein the at least one heater has a useful air inlet and a useful air outlet, which are connected in a communicating manner to the dryer housing.

6. The dryer of claim 1, wherein a plurality of heaters are arranged along the dryer housing.

7. The dryer of claim 6, wherein an air inlet and an air outlet are connected in a communicating manner in each case to air shafts arranged laterally on the dryer housing and provided with air-permeable wall sections.

8. The dryer of claim 1, wherein a hot air outlet of the heat exchanger is connected to an end region of the dryer housing.

9. The dryer of claim 1, wherein at least one heater is arranged above the dryer housing.

10. The dryer of claim 1, wherein a transverse extent of the at least one heater corresponds to a part of a transverse extent of the dryer housing.

11. The dryer of claim 1, wherein the thermal combustion device is designed for part-load operation of the dryer.

12. The dryer of claim 11, characterised in that the thermal combustion device is designed to produce 75 percent of the heating power required for maximum operation, based on maximum utilisation of the dryer.

13. The dryer of claim 1, wherein a hot air outlet of the heat exchanger is connected to a lock region of the dryer housing.

14. A dryer for a painting facility a) having a dryer housing, in which heated air is circulated;

b) having an exhaust air line for removing exhaust air from the dryer housing;

c) having a thermal combustion device, which is connected to the exhaust air line and which serves for thermal post-treatment of the exhaust air from the dryer housing and for providing heating air to a heat exchanger;

d) the heat exchanger being set up to supply the dryer housing with heated fresh air; and e) at least one heater for heating the air circulated in the dryer housing being associated with the dryer housing, wherein f) a combustion air supply of the at least one heater is connected in a communicating manner to the dryer housing and the thermal combustion device is designed for part-load operation of the dryer.

* * * * *